US010364602B2

(12) United States Patent
Kwak

(10) Patent No.: US 10,364,602 B2
(45) Date of Patent: Jul. 30, 2019

(54) SPRING PRE-TENSIONING DEVICE FOR ROLL BLIND

(71) Applicant: Jae-Suk Kwak, Paju-si (KR)

(72) Inventor: Jae-Suk Kwak, Paju-si (KR)

(73) Assignee: Jae-Suk KWAK, Paju-si, Gyeonggi-do (KR)

( * ) Notice: Subject to any disclaimer, the term of this patent is extended or adjusted under 35 U.S.C. 154(b) by 186 days.

(21) Appl. No.: 15/407,667

(22) Filed: Jan. 17, 2017

(65) Prior Publication Data

US 2018/0179814 A1 Jun. 28, 2018

(30) Foreign Application Priority Data

Dec. 26, 2016 (KR) ..... 10-2016-0179173

(51) Int. Cl.

| | |
|---|---|
| ***E06B 9/40*** | (2006.01) |
| ***E06B 9/60*** | (2006.01) |
| ***E06B 9/42*** | (2006.01) |
| ***E06B 9/50*** | (2006.01) |

(52) U.S. Cl.

CPC ..... *E06B 9/60* (2013.01); *E06B 9/42* (2013.01); *E06B 9/50* (2013.01)

(58) Field of Classification Search

CPC ..... E06B 9/60; E06B 9/62; E06B 9/42; E06B 9/50; E06B 9/56

USPC ..... 160/294, 299, 301, 302, 305, 306, 313, 160/315, 318

See application file for complete search history.

(56) References Cited

U.S. PATENT DOCUMENTS

| | | | | |
|---|---|---|---|---|
| 718,178 A * | 1/1903 | Vickery | E06B 9/54 | 160/295 |
| 823,452 A * | 6/1906 | Vickery | E06B 9/60 | 160/263 |
| 958,605 A * | 5/1910 | Doring | E06B 9/60 | 160/313 |
| 1,416,071 A * | 5/1922 | Smurr | E05D 13/1238 | 16/198 |
| 1,641,506 A * | 9/1927 | Smurr | E06B 9/60 | 160/315 |

(Continued)

FOREIGN PATENT DOCUMENTS

| | | | |
|---|---|---|---|
| DE | 4211940 A1 * 10/1993 | ..... | E06B 9/56 |
| EP | 0210381 A2 * 2/1987 | ..... | E06B 9/60 |

(Continued)

*Primary Examiner* — Johnnie A. Shablack

(74) *Attorney, Agent, or Firm* — Rabin & Berdo, P.C.

(57) ABSTRACT

A spring pre-tensioning device for a roll blind is provided. The pre-tensioning device includes a rotation shaft including a threaded part, with a restraining protrusion provided on the threaded part, and a locking groove. The pre-tensioning device also includes a restraining nut engaged with the threaded part of the rotation shaft, and disposed on the restraining protrusion, so as to prevent the restraining nut from moving further forward; a restraining body provided with a shaft insertion hole therein, and provided with a locking protrusion and a locking clip and a spring. The restraining body is fitted over the outer circumferential surface of the rotation shaft and is fixedly connected to the spring is rotated to apply a predetermined pretension value to the spring, and is engaged with the restraining nut that is prevented from forward rotation, thereby restraining pretension of the spring.

8 Claims, 12 Drawing Sheets

(56) References Cited

U.S. PATENT DOCUMENTS 1,885,400 A * 11/1932 Ygger ..... E06B 9/88 160/295
3,311,159 A * 3/1967 Stansberry ..... E05F 15/686 160/189
3,412,423 A * 11/1968 Binns ..... E05D 13/1261 16/198
4,373,569 A * 2/1983 Barettella ..... E06B 9/44 160/263
4,427,050 A * 1/1984 Toppen ..... E06B 9/60 160/315
4,429,729 A * 2/1984 Winslow ..... E06B 9/60 144/193.1
4,456,049 A * 6/1984 Vecchiarelli ..... E06B 9/307 160/107
4,482,137 A * 11/1984 Gavagan ..... B60R 5/047 160/315
4,523,620 A * 6/1985 Mortellite ..... E06B 9/60 160/315
5,078,198 A * 1/1992 Tedeschi ..... E06B 9/60 160/301
5,437,324 A * 8/1995 Sternquist ..... E06B 9/44 160/299
6,135,189 A * 10/2000 Weinreich ..... E06B 9/322 160/171
6,155,328 A * 12/2000 Welfonder ..... E06B 9/42 160/296
6,244,325 B1 * 6/2001 Miller ..... E06B 9/62 160/310
6,327,744 B1 * 12/2001 Dorma ..... E05D 13/1261 16/197
6,401,793 B1 * 6/2002 Martin ..... E05D 13/1261 160/189
6,408,925 B1 * 6/2002 Dorma ..... E05D 13/1261 160/191
6,443,210 B1 * 9/2002 Welfonder ..... E06B 9/42 160/296
6,467,714 B1 * 10/2002 Rasmussen ..... E06B 9/44 160/296
6,615,897 B2 * 9/2003 Dorma ..... E05D 13/1261 16/197
6,666,252 B2 * 12/2003 Welfonder ..... E06B 9/42 160/296
6,782,938 B2 * 8/2004 Colson ..... E06B 9/32 160/121.1
6,823,927 B2 * 11/2004 Steel ..... E05D 3/022 16/49
6,938,667 B2 * 9/2005 Sugiyama ..... E06B 9/54 160/296
6,955,207 B2 * 10/2005 Minder ..... E06B 9/44 160/293.1
7,234,503 B2 * 6/2007 Kwak ..... E06B 9/42 160/295
7,243,467 B2 * 7/2007 Peccoraro ..... E06B 9/02 52/127.2
7,461,683 B2 * 12/2008 Wang ..... E06B 9/44 160/291
7,549,458 B2 * 6/2009 Kwak ..... E06B 9/42 160/319
7,624,476 B1 * 12/2009 Lin ..... E05F 1/16 16/71
8,281,846 B2 * 10/2012 Zhu ..... E06B 9/42 160/168.1 R
8,517,081 B2 * 8/2013 Huang ..... E06B 9/60 160/294
8,776,861 B2 * 7/2014 Bohlen ..... E06B 9/62 160/310
9,027,625 B2 * 5/2015 Persson ..... E06B 9/42 160/23.1
9,062,494 B2 * 6/2015 Chen ..... E06B 9/60
9,080,381 B2 * 7/2015 Haarer ..... E06B 9/42
9,322,214 B2 * 4/2016 Bohlen ..... E06B 9/88
9,353,570 B2 * 5/2016 Smith ..... E06B 9/38
9,593,530 B1 * 3/2017 Anthony ..... E06B 9/80
9,617,787 B2 * 4/2017 Bohlen ..... E06B 9/80
9,631,425 B2 * 4/2017 Campagna ..... E06B 9/60
9,739,089 B2 * 8/2017 Smith ..... E06B 9/60
9,879,479 B2 * 1/2018 Haarer ..... E06B 9/42
10,030,439 B2 * 7/2018 Smith ..... E06B 9/38
10,030,442 B2 * 7/2018 Bohlen ..... E06B 9/62
2008/0190572 A1 * 8/2008 Kwak ..... E06B 9/42 160/313
2009/0308547 A1 * 12/2009 Kwak ..... E06B 9/42 160/368.1
2011/0005694 A1 * 1/2011 Ng ..... E06B 9/44 160/311
2011/0024064 A1 * 2/2011 Ng ..... E06B 9/42 160/317
2011/0247768 A1 * 10/2011 Kwak ..... E06B 9/326 160/319
2012/0167702 A1 * 7/2012 Dangel ..... E06B 9/68 74/405
2013/0062024 A1 * 3/2013 Huang ..... E06B 9/50 160/127
2014/0374036 A1 * 12/2014 Chen ..... E06B 9/60 160/313
2015/0285000 A1 * 10/2015 Liu ..... E06B 9/80 242/396
2015/0330143 A1 * 11/2015 Shevick ..... E06B 9/50 52/745.15
2015/0376941 A1 * 12/2015 Fujita ..... E06B 9/26 160/241
2016/0010390 A1 * 1/2016 Smith ..... E06B 9/60 160/302
2016/0258211 A1 * 9/2016 Smith ..... E06B 9/38
2017/0107760 A1 * 4/2017 Campagna ..... E06B 9/60
2017/0175440 A1 * 6/2017 Bohlen ..... E06B 9/80
2018/0106107 A1 * 4/2018 Smith ..... E06B 9/42
2018/0155984 A1 * 6/2018 Jay ..... E06B 9/88
2018/0171709 A1 * 6/2018 Haarer ..... E06B 9/42
2018/0179814 A1 * 6/2018 Kwak ..... E06B 9/42
2018/0216404 A1 * 8/2018 Fisher ..... E06B 9/60

FOREIGN PATENT DOCUMENTS

FR 2476735 A1 * 8/1981 ..... E06B 9/60
KR 20-0414516 Y1 4/2006
KR 20-0478475 Y1 10/2015

* cited by examiner (Background of Art)

(Background of Art)

(Background of Art)

(Background of Art)

SPRING PRE-TENSIONING DEVICE FOR ROLL BLIND

CROSS REFERENCE TO RELATED APPLICATION

The present application claims priority to Korean Patent Application No. 10-2016-0179173, filed Dec. 26, 2016, the entire contents of which is incorporated herein for all purposes by this reference.

BACKGROUND OF THE INVENTION

Field of the Invention

The present invention generally relates to a spring pre-tensioning device for a roll blind. More particularly, the present invention relates to a spring pre-tensioning device for a roll blind, the pre-tensioning device configured such that a predetermined tension value of the spring is restrained to be constant through a predetermined number of rotations, whereby a precise tension value is applied to the roll blind such that a screen moves up and down smoothly. Further, the pre-tensioning device has the following advantages: it has a very high economic value since it can be applied to any blind that is provided with a spring; it does not require adjustment of tension of the spring according to a size or a weight of roll screen fabric since it is pretensioned when manufactured; and it is configured to allow a blind to be easily attached to an detached from a bracket via a new bracket structure.

Description of the Related Art

Generally, a roll screen blind is used instead of a curtain at home, in an office, or in a restaurant, and is configured such that a screen is made of textile or synthetic resin, and when a ball chain of a sprocket provided in a bracket is pulled down in one direction, the screen rolled around a rotating tube is unrolled by tension of a spring, thereby blocking light coming through the window.

As shown in FIG. 1, a roll blind 20 is provided with a rotating body 10 on a front surface of each bracket 9.

One rotating body 10 is provided with a rotating member 2 on a front surface thereof, and a back surface thereof is provided with a rotating unit that is fixedly provided with a connection shaft 3 having a spring 4.

The rotating member 2 moves left and right along the connection shaft 3 by elastic force of the spring 4.

Further, the other rotating body 10 is provided with a reduction unit that is provided with a fixed shaft 7 having a reduction nut 7*a* in front of a reducer 6.

As shown in FIG. 2, the rotating body 10 is configured such that an outer surface of a rotating tube with the screen being rolled therearound is fitted under the cover 16 by inserting the rotating tube 30 into the cover. Further, an inside of the rotating tube 30 is coupled to a rotation shaft 40 with the spring being provided on an outer surface thereof, and is fixed using a washer.

In this state, the rotating tube is fitted over the outer surface of each rotating body 10 that the screen is rolled around, and a bracket is locked to a window frame or a door frame to use the blind.

However, a conventional blind is problematic in that in order to keep an initial state of the spring and a state where tension is applied to the spring, a head rail is required, whereby manufacturing cost may be increased.

The conventional blind is further problematic in that since tension of the rotation shaft provided inside the rotating body may be loosen during transport or installation, a customer adjusts the tension him or herself, and thus returns may increase if the customer fails to adjust the tension.

To solve the above mentioned problem, 'Safety pin apparatus for preventing unwinding tension' is disclosed in Korean Utility Model Registration No. 0478475.

As shown in FIG. 3, the safety pin apparatus, in which a roll screen blind includes a rotating tube provided with a rotation shaft that is rotated by tension of a spring; the rotating tube inserted inside a cover, which a winding tube with a screen being rolled around an outer circumferential surface thereof is coupled to, such that the rotating tube, along with a rotating body, is rotated by a rotation of the rotation shaft, and the screen is moved up and down, the safety pin apparatus includes: a rotation shaft 110 provided with a plurality of annular insertion holes 111 on an outer circumferential surface of a rear end thereof; and a rotating tube 120 inserted into the rotation shaft 110, and provided with a plurality of coupling holes 121 through an outer circumferential surface of a rear end thereof, wherein the rotation shaft 110 is inserted into the rotating tube 120, such that the insertion holes 111 of the rotation shaft 110 and the coupling holes 121 of the rotating tube 120 are aligned with each other, and a safety pin 130 having a handle 131 is engaged with the insertion holes 111, thereby restraining rotations of the rotating tube 120.

However, the above mentioned apparatus is problematic in that since the safety pin is exposed outside, it may fall out by an external force during transport, whereby tension of the spring may be loosened.

Further, 'Apparatus for attaching and detaching roll screen' is disclosed in Korean Utility Model Registration No. 0414516, which allows easily detaching a rotation shaft locked to a bracket.

As shown in FIG. 4, the apparatus for attaching and detaching a roll screen includes: a carriage 20 configured such that a front portion thereof is provided with a washer groove 21, a back portion thereof is provided with a coupling member 22, a center of an outer surface thereof is formed with a locking plate 23, and a portion of the outer surface thereof is provided with an oblong coupling protrusion 24; an elastic spring 30 provided in front of the carriage 20, and coupled to come into close contact with the locking plate 23; a cover 40 inserted into the front portion of the carriage 20, and including an insertion hole 41 provided therein, with a coupling groove 42 formed in a front surface thereof, a guide hole 43 provided at each opposite side to correspond to each other, and a coupling plate 45 with a coupling holes 44; and a rotating member 50 coupled to the back of the carriage 20 to be coupled to the cover 40, and including an insertion member 52 with a guide groove 51 being at a predetermined angle formed on an outer circumferential surface thereof, and a handle 54 formed with a protrusion 53 having a stop protrusion 53*a*.

However, the above mentioned apparatus is problematic in that manufacturing cost may be increased by the complex structure thereof, and additional components in addition to the bracket are required in.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and the present invention is intended to propose a spring pre-tensioning device for a roll blind, the device configured such that a predetermined tension value of the spring is restrained to be constant through a predetermined number of rotations, whereby the tension of the spring is not required to be adjusted by a manufacturer in mass production, and it is possible to prevent tension from being loosened during transport or installation.

The present invention is further intended to propose a spring pre-tensioning device for a roll blind, the device configured such that a precise tension value is applied to the roll blind such that a screen moves up and down smoothly, and only by providing a pretensioned spring, the device can be applied to a roll screen without fault, whereby it is possible to increase economic value and reduce manufacturing cost.

The present invention is further intended to propose a spring pre-tensioning device for a roll blind, the device configured such that a bracket is configured to be separated into a body and a coupling member, thereby facilitating installation of a blind.

In order to achieve the above object, according to one aspect of the present invention, there is provided a spring pre-tensioning device for a roll blind, the pre-tensioning device including: a rotation shaft including a threaded part having a predetermined length provided on an outer circumferential surface of a first side thereof, with a restraining protrusion provided on the threaded part, and a locking groove provided at an end of a second side thereof; a restraining nut engaged with the threaded part of the rotation shaft, and disposed on the restraining protrusion provided at an end of the threaded part, so as to prevent the restraining nut from moving further forward; a restraining body provided with a shaft insertion hole therein, and provided with a locking protrusion and a locking clip on an outer circumferential surface thereof for allowing a spring to be connected and locked thereto; and the spring configured such that a first end thereof is locked by the locking protrusion of the restraining body, and a second end thereof is coupled to the locking groove of the rotation shaft, wherein the restraining body that is fitted over the outer circumferential surface of the rotation shaft and is fixedly connected to the spring is rotated to apply a predetermined pretension value to the spring, and is engaged with the restraining nut that is prevented from forward rotation, thereby restraining pretension of the spring.

The spring pre-tensioning device is advantageous in that a predetermined tension value of the spring is restrained to be constant through a predetermined number of rotations, whereby a precise tension value is applied to the roll blind such that a screen moves up and down smoothly.

The spring pre-tensioning device is further advantageous in that it can be applied to any blind that is provided with a spring, and thus the spring pre-tensioning device has a very high economic value, and tension of the spring is not need to be adjusted by a customer or a manufacturer, whereby it is possible to reduce manufacturing cost.

The spring pre-tensioning device is further advantageous in that it is possible to easily attach and detach a blind through a bracket that is configured to be separated into a body and a coupling member.

BRIEF DESCRIPTION OF THE DRAWINGS

The above and other objects, features and other advantages of the present invention will be more clearly understood from the following detailed description when taken in conjunction with the accompanying drawings, in which:

FIG. 14 is a whole sectional view showing another configuration of the present invention.

DETAILED DESCRIPTION OF THE INVENTION

Figure 1:
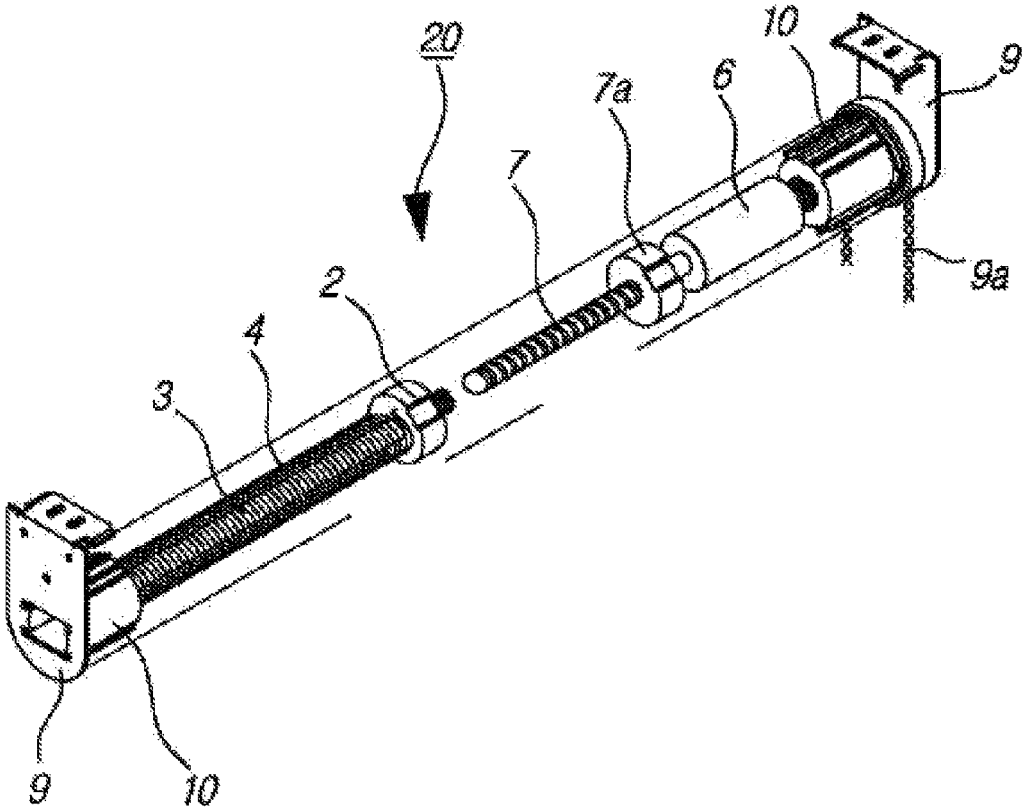
FIGS. 1 to 4 are views showing a conventional configuration.
Figure 2:
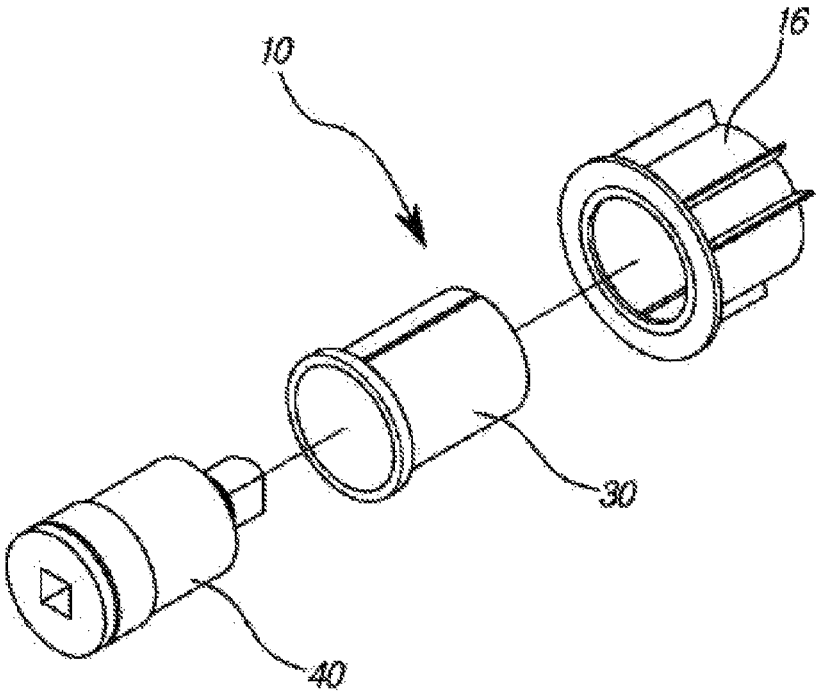
Figure 3:
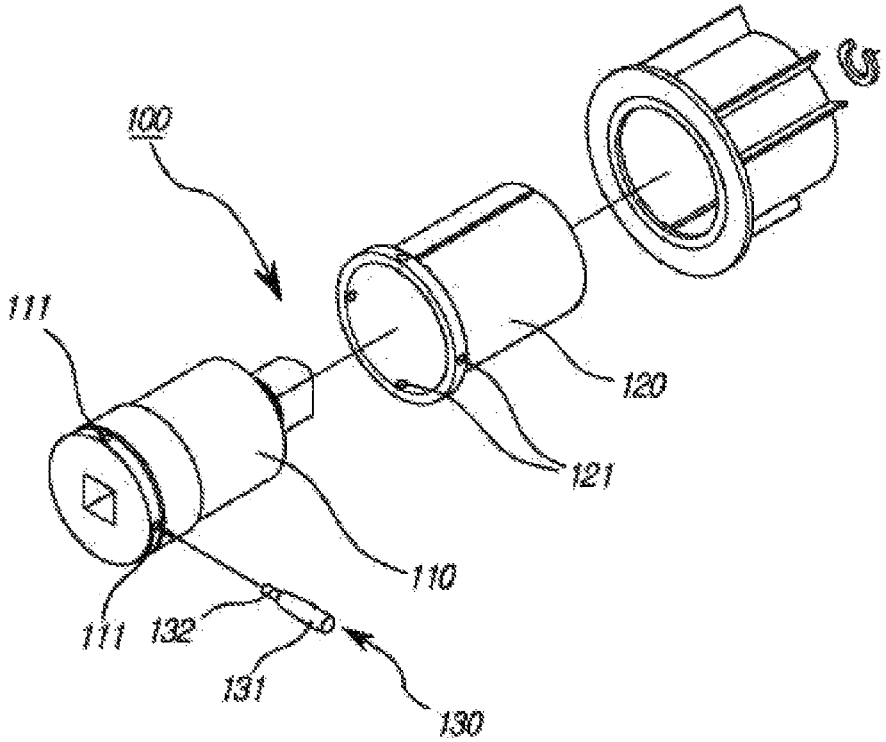
Figure 4:
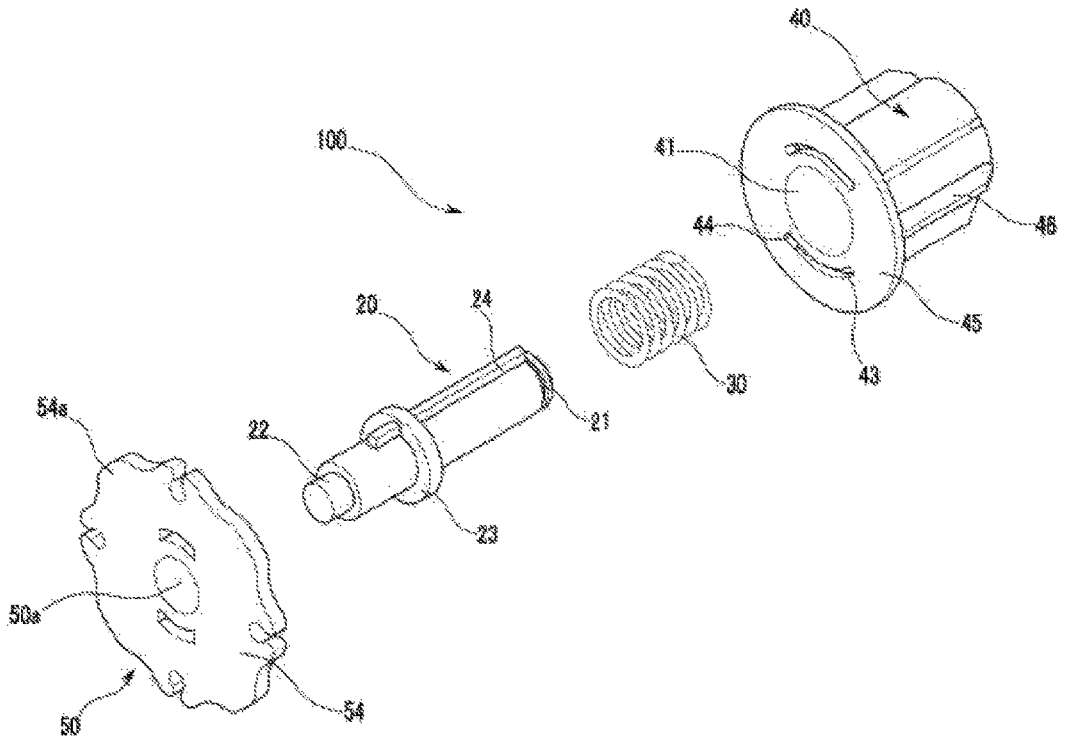

Hereinbelow, exemplary embodiments of the present invention will be described in detail with reference to the accompanying drawings. Throughout the drawings, the same reference numerals will refer to the same or like parts.

Figure 5:
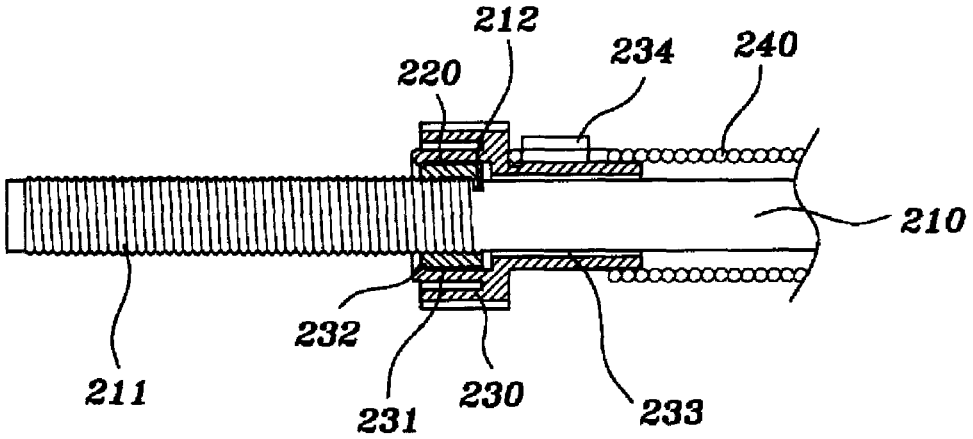
FIGS. 5 to 7 are sectional views and perspective views showing a configuration of the present invention.
Figure 11:
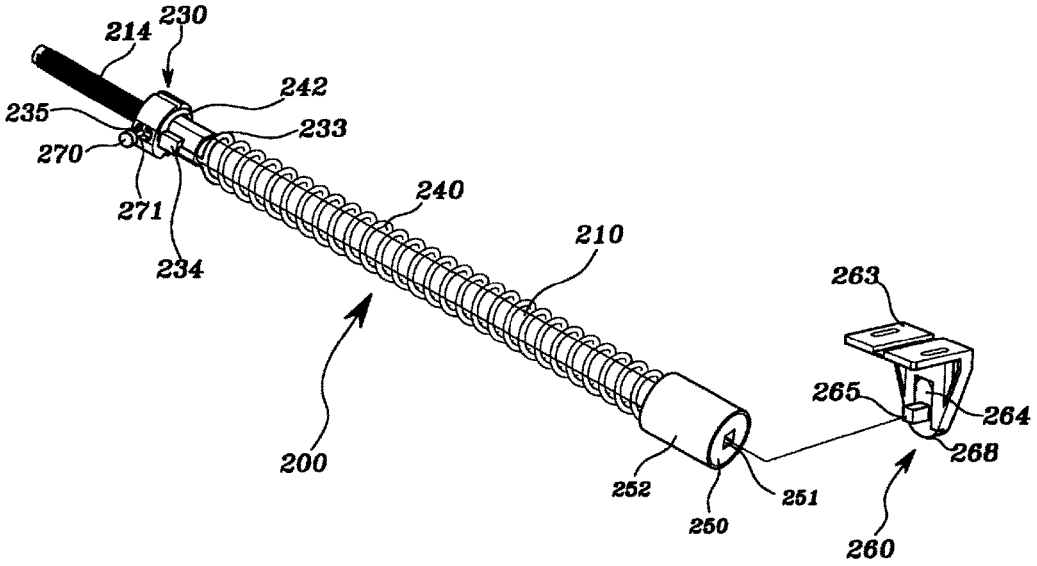
FIG. 11 is a perspective view showing another configuration of the present invention.
Figure 12:
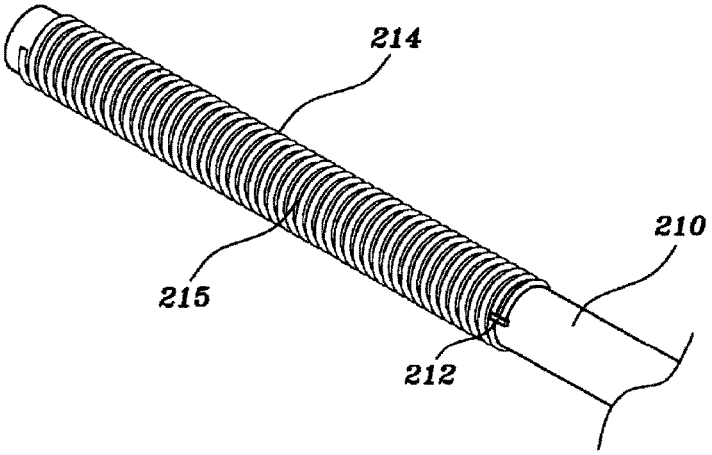
FIG. 12 is a perspective view showing a rotation shaft of the present invention formed with a screw.
Figure 13:
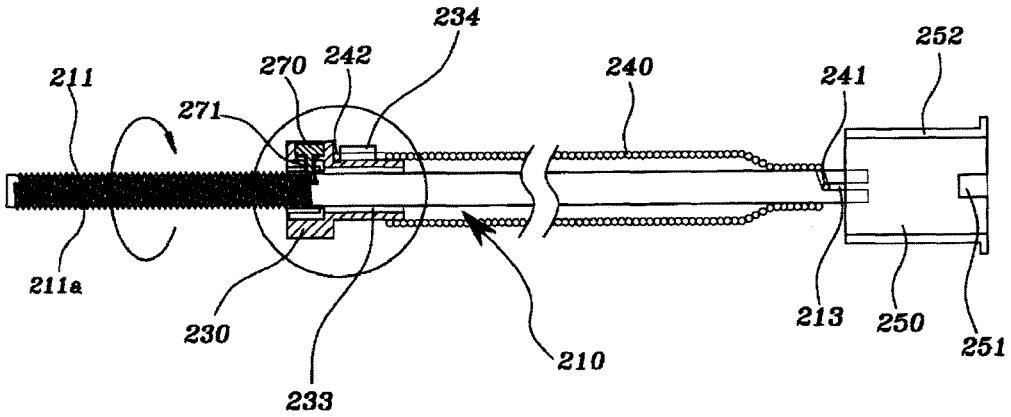
FIGS. 13 to 14 are partially enlarged sectional views showing another configuration of the present invention.
Figure 14:
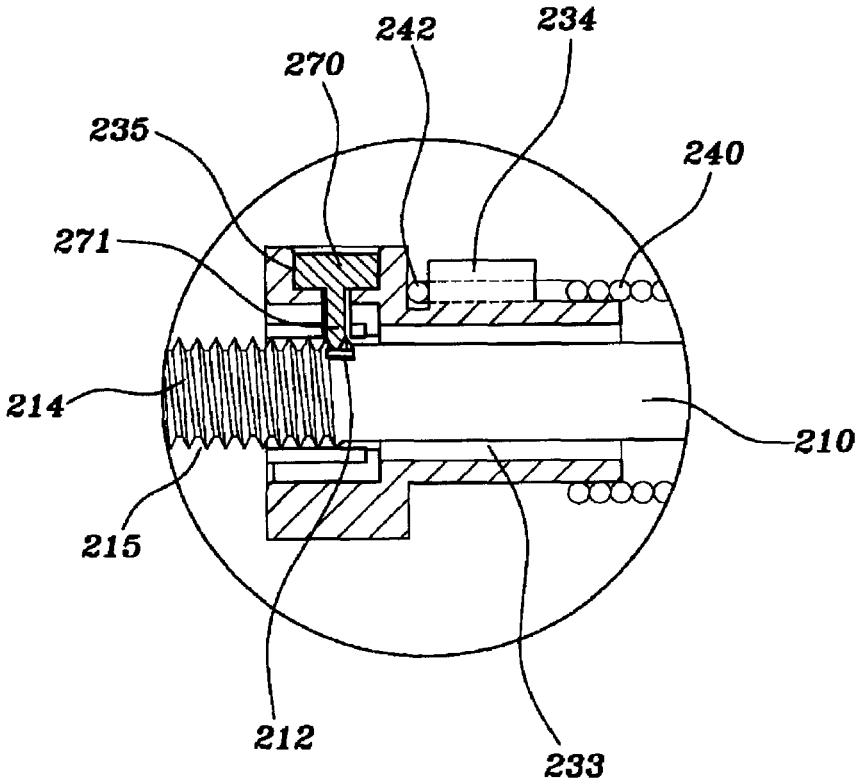
Figure 15:
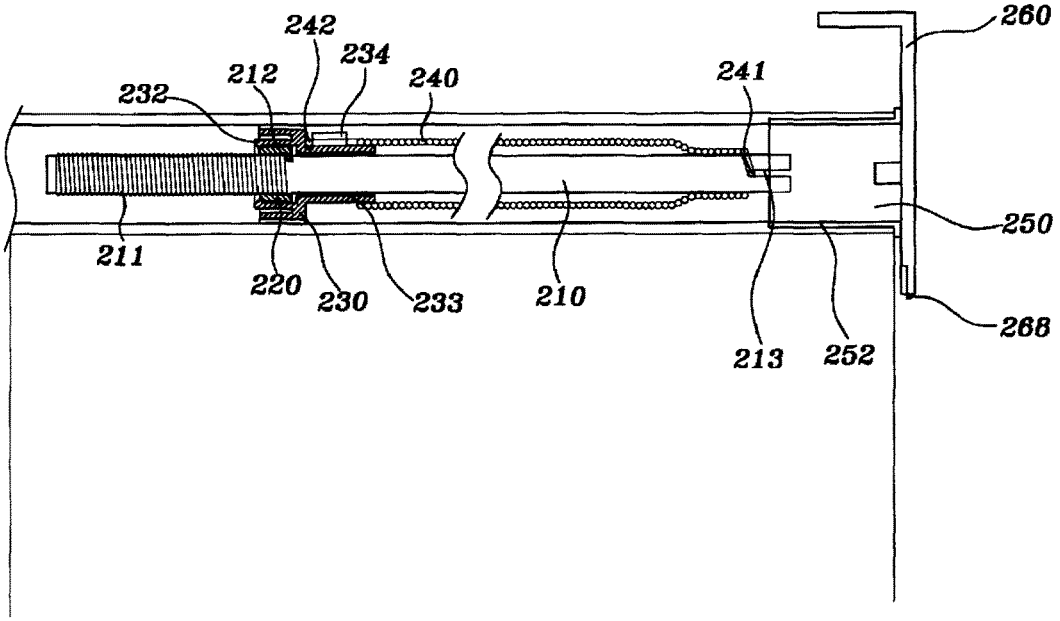
FIGS. 15 to 16 are sectional views showing an installation state of the present invention.

FIG. 5 is a sectional view showing an entire configuration of the present invention; FIGS. 6 to 10 are views showing a configuration of each component of the present invention; FIGS. 11 to 13 are views showing another configuration of the present invention; and FIGS. 14 to 15 are sectional views showing an installation state of the present invention.

Reference numeral 200 refers to a spring pre-tensioning device for a roll blind of the present invention.

The spring pre-tensioning device 200 for a roll blind, the pre-tensioning device includes: a rotation shaft 210 including a threaded part 211 provided with a restraining protrusion 212, and a locking groove 213; a restraining nut 220 disposed at the restraining protrusion 212 provided at an end of the threaded part 211 of the rotation shaft 210, so as not to move further forward; the restraining body 230 that is fitted over the outer circumferential surface of the rotation shaft 210 and is fixedly connected to the spring 240 is rotated to apply a predetermined pretension value to the spring 240, and is engaged with an outer surface of the restraining nut 220, thereby restraining pretension of the spring 240.

As shown in FIG. 5, the rotation shaft 210 includes: the threaded part 211 having a predetermined length provided on an outer circumferential surface of a first side of the rotation shaft, with the restraining protrusion 212 provided on the threaded part; the locking groove 213 provided at an end of a second side thereof so as to allow a stop protrusion of the spring 240 to be locked thereinto.

Figure 6:
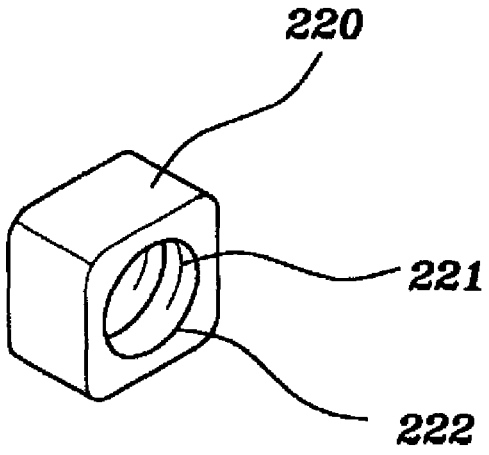

As shown in FIG. 6, the restraining nut 220 is formed into a quadrangular body, and is provided with an insertion hole 222 through the restraining nut, with threads 221 being formed on the inner surface thereof.

Figure 7:
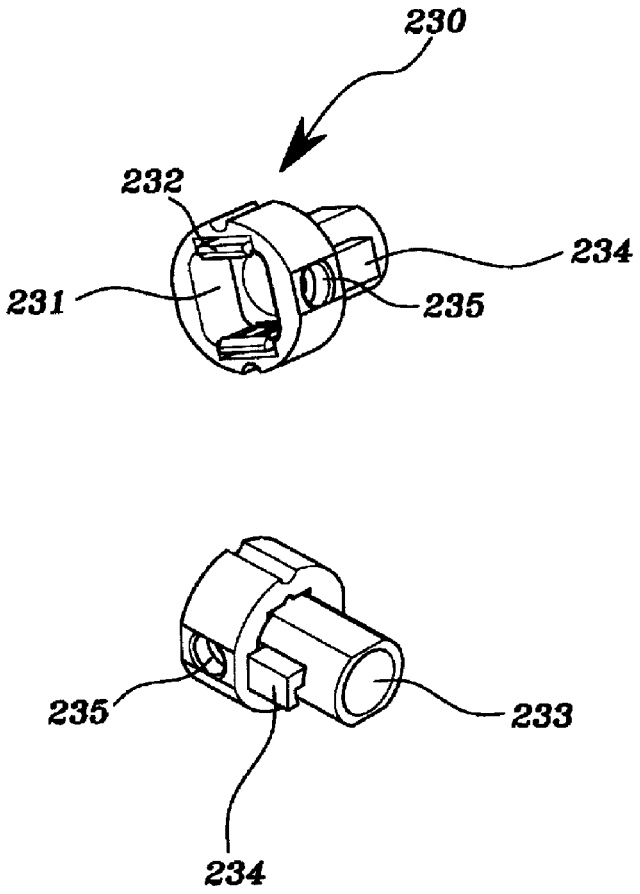

As shown in FIG. 7, a back surface of the restraining body 230 is provided with a nut insertion hole 231 having a quadrangular inner space, and the restraining body is provided with a locking clip 232 at each of opposite sides thereof.

Further, a front surface of the restraining body is provided with a shaft insertion hole 233, and an outer surface thereof is provided with a locking protrusion 234 and a pin insertion hole 235 for allowing the spring 240 to be connected and locked thereto.

The spring 240 is configured such that a first end thereof is fixedly mounted at the locking protrusion 234 of the restraining body 230, and a second end thereof is engaged with the locking groove 213 of the rotation shaft 210.

Figure 8:
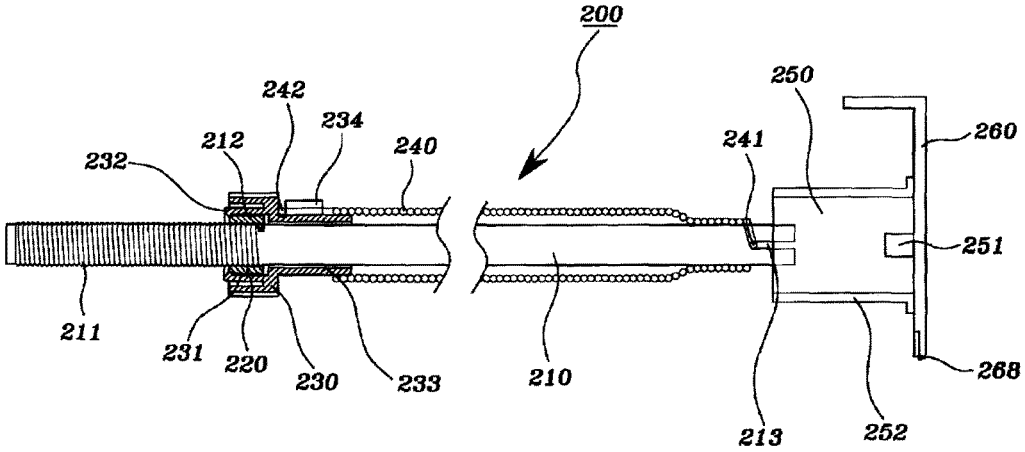
FIG. 8 is a perspective view showing a configuration of a restraining body of the present invention.

As shown in FIG. 8, the threads 221 of the restraining nut 220 are engaged with the threaded part 211 of the rotation shaft 210, and are rotated to be disposed in the restraining protrusion 212 that is provided at the end of the threaded part 211, so as not to move further forward.

As described above, in the state where the restraining nut 220 is locked, the restraining body 230 that is connected to the first end of the spring 240 is rotated a predetermined number of times relative to the outer circumferential surface of the rotation shaft 210, thereby applying a tension value in advance.

Here, a pretension value may be adjustable according to a size of a roll blind or a length of roll screen fabric.

As described above, after the pretension value is applied, the locking clip 232 of the restraining body 230 is engaged with the outer surface of the restraining nut 220, whereby the tension value of the spring 240 is restrained to be constant.

Further, a piece is mounted at an outside of an outer surface of the restraining body 230 so as to lock the restraining nut 220, such that the restraining body 230 is prevented from being separated from the restraining nut 220.

Further, the end of the threaded part 211 of the rotation shaft 210 is not provided with the restraining protrusion 212, such that the restraining nut 220 engaged with the threaded part 211 is prevented from moving forward over a portion that is not provided with threads.

The locking groove 213 of the rotation shaft 210 is engaged with a rotating member 250 that is provided with a quadrangular coupling groove 251 on a back surface thereof; a rotating tube 252 is rotatably provided on an outer surface of the rotating member 250; and a roll screen having a predetermined length is rolled around an outer circumferential surface of the rotating tube 252.

Figure 9:
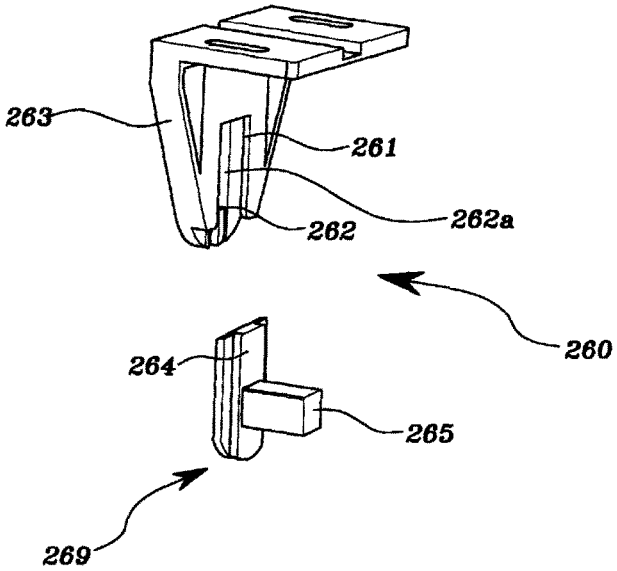
FIGS. 9 to 10 are perspective views showing a configuration of a bracket of the present invention.
Figure 10:
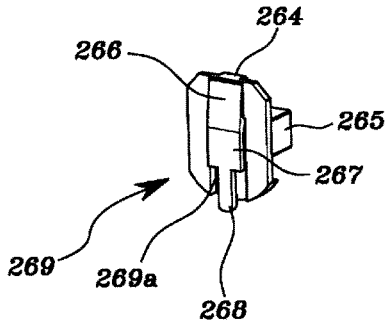

A bracket 260 is fixedly engaged with the coupling groove 251 of the rotating member 250; and as shown in FIGS. 9 and 10, the bracket 260 includes a body 263, and coupling member 269 that is detachable from the body 263.

The body 263 is configured such that a lower portion thereof and a center of a front surface thereof are open, a guide groove 261 is provided at each of opposite sides thereof being spaced at a predetermined interval, and a surface thereof is provided with a slit 262*a* that is in a C shape and is provided with a stop groove 262 at a lower portion of the body.

The coupling member 269 is protrudingly provided with a guide protrusion 264 with a predetermined thickness on a front surface thereof and is provided with a coupling protrusion 265 protruding outwardly under the guide protrusion.

Further, an oblong groove 269*a* is provided at a center of a back surface of the coupling member, and an elastic stopper 267 that includes an inclined surface 266 and a separation pin 268 protruding downward provided respectively at an upper portion and a lower portion thereof is provided above the groove.

When the coupling member 269 is coupled to the body 263, the guide protrusion 264 is engaged with the guide groove 261 of the body 263 and is pushed up, whereby the elastic stopper 267 at the back is engaged with the slit 262*a* while going up, and at the same time, a lower portion of the elastic stopper 267 comes into close contact with and is locked to an upper portion of the stop groove 262.

Here, the separation pin 268 is engaged with the stop groove 262, and a lower portion thereof is exposed outside of the body 263. In the above mentioned state, when the separation pin 268, a portion of which is exposed outside of the body 263, is pushed forward, the elastic stopper 267 is separated from the stop groove 262 by its elastic force. Here, the coupling member 269 is moved down to be separated from the body 263, whereby it is possible to attach and detach a blind to and from the bracket.

Reference will be made to another configuration of the present invention, with reference to FIG. 11, hereinafter.

A spring pre-tensioning device for a roll blind according to another embodiment of the present invention includes: a rotation shaft 210 including a screw 214 provided with a restraining protrusion 212, and a locking groove 213; a restraining body 230 provided with a shaft insertion hole 233 therein, and provided with a locking protrusion 234 and a pin insertion hole 235 on an outer circumferential surface thereof for allowing a spring to be connected and locked thereto; and the spring 240 configured such that a first end thereof is locked by the locking protrusion 234 of the restraining body 230, and a second end thereof is coupled to the locking groove 213 of the rotation shaft 210, wherein the shaft insertion hole 233 of the restraining body 230 is fitted over the outer circumferential surface of the rotation shaft 210; the restraining body 230 is rotated to apply tension to the spring 240; and after the restraining protrusion 212 provided at an end of the screw 214, and the pin insertion hole 235 of the restraining body 230 are aligned with each other, a locking member 270 is engaged with an end of roots 215 of the screw 214, thereby restraining a tension limit value of the spring 240.

As shown in FIG. 12, the outer circumferential surface of the first side of the rotation shaft 210 is provided with the screw 214 having the roots 215 that are spaced apart from each other at predetermined intervals, and the end of the screw 214 is provided with the restraining protrusion 212 having a predetermined height.

As shown in FIG. 7, the restraining body 230 is provided with the shaft insertion hole 233 in a front surface thereof, and the locking protrusion 234 and the pin insertion hole 235 are provided in the outer surface of the restraining body for allowing the spring 240 to be connected and locked thereto.

The spring 240 is configured such that a first end thereof is locked by the locking protrusion 234 of the restraining body (230), and a second end thereof is coupled to the locking groove 213 of the rotation shaft 210.

As shown in FIGS. 13 and 14, after the shaft insertion hole 233 of the restraining body 230 is fitted over the outer circumferential surface of the rotation shaft 210, the restraining body 230 is rotated a predetermined number of times to apply a tension value.

Here, the restraining body 230 is disposed in the restraining protrusion 212 provided at the end of the screw 214, and the locking member 270 having a locking pin 271 protruding outwardly is engaged with the pin insertion hole 235 of the restraining body 230, thereby being locked to the roots 215 of the screw 214.

The locking pin 271 of the locking member 270 restrains the tension of the spring 240 that is pretensioned, in such a way that the locking pin restrains a direction where the spring is restored.

A rotating member 250 is engaged with the locking groove 213 of the rotation shaft 210, and the rotating member 250 is coupled to a bracket 260 in the same way as the above mentioned manner.

Reference will be made to operation of the present invention, with reference to FIG. 15, hereinafter.

A tension value that corresponds to a size of a roll blind or a length of roll screen fabric is applied in advance, wherein firstly, the restraining nut 220 is engaged with the threaded part 211 of the rotation shaft 210 and is rotated to reach the restraining protrusion 212, so as not to move further forward.

Then, after the restraining body 230 that is connected to the spring 240 is rotated a predetermined number of times, thereby applying a tension value, the locking clip 232 is locked to the outer surface of the restraining nut 220 restrained by the rotation shaft 210.

As described above, spring 240 is restrained in a state where the tension value is applied, whereby the roll blind can be stopped at the same position.

Figure 16:
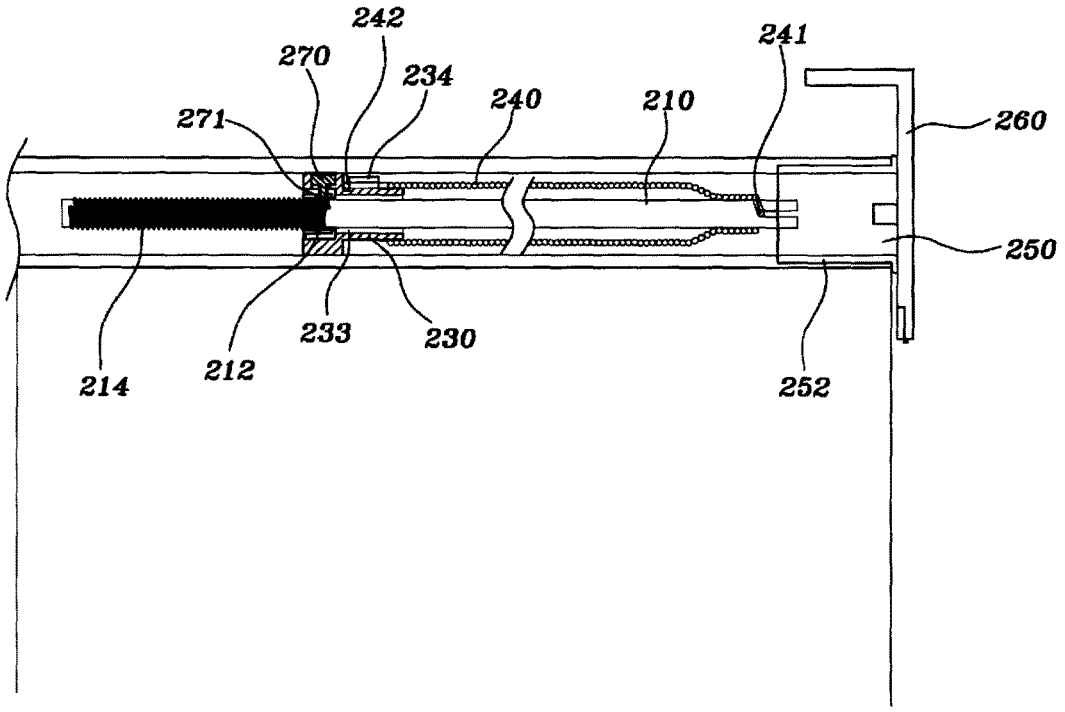

Reference will be made to operation of the spring pre-tensioning device according to another embodiment of the present invention, with reference to FIG. 16, hereinafter.

In order to apply a tension value that corresponds to a size of a roll blind or a length of roll screen fabric, firstly, the restraining body 230 engaged with the screw 214 of the rotation shaft 210 is rotated a predetermined number of times to adjust tension, thereby applying the tension value.

Then, the restraining body 230 is disposed in the restraining protrusion 212 provided at the end of the screw 214, and the locking pin 271 of the locking member 270 is engaged with the roots 215 of the screw 214, thereby restraining the restraining body 230.

Here, the locking pin 271 of the locking member 270 serves to stop the blind to have a predetermined tension value of the spring.

The present invention, in which the spring 240 is applied the tension value as described above, is locked to opposite sides of a top surface of a window frame or a door frame by using the bracket 260, without a head rail.

Then, the rotating tube 252, which the roll screen is rolled around, is mounted to the outer surface of the rotating member 250, and at opposite location of the rotating tube, the another rotating tube having a reducer is mounted to a bracket that is not detachable.

Here, after the coupling member 269 is separated from the bracket 260 and the coupling groove 251 of the rotating member 250 is engaged with the coupling protrusion 265 of the coupling member 269, the guide protrusion is engaged with the guide groove 261 of the body 263 and is pushed up, whereby the elastic stopper 267 is engaged with the slit 262*a* and is locked thereto.

As described above, after the blind is mounted to the bracket 260, when the screen fabric is pulled down, the restraining body 230 goes down while being rotated along the locking pin 271 engaged with the roots 215 of the screw 214.

Here, although the number of rotations of the spring 240 exceeds a predetermined number of rotations, the restraining body 230 is rotated along the screw 214, and is stopped by being locked the restraining protrusion 212 of the screw 214, thereby being restrained at a predetermined tension value.

As described above, the present invention is restrained at a predetermined tension value under any circumstance, so it is advantageous in that it is not required to adjust a tension value while using it, and an initial set value is not changed by repetitive motions.

Although a preferred embodiment of the present invention has been described for illustrative purposes, those skilled in the art will appreciate that various modifications, additions and substitutions are possible, without departing from the scope and spirit of the invention as disclosed in the accompanying claims.

[Description of reference characters of important parts]

| | |
|---|---|
| 200: spring pre-tensioning device for a roll blind | |
| 210: rotation shaft | 211: threaded part |
| 212: restraining protrusion | 213: locking groove |
| 214: screw | 215: roots |
| 220: restraining nut | 230: restraining body |
| 231: nut insertion hole | 232: locking clip |
| 233: shaft insertion hole | 234: locking protrusion |
| 235: pin insertion hole | 240: spring |
| 250: rotating member | 260: bracket |
| 261: guide groove | 262: stop groove |
| 263: body | 264: guide protrusion |
| 265: coupling protrusion | 267: elastic stopper |
| 268: separation pin | 269: coupling member |
| 270: locking member | 271: locking pin |

What is claimed is:

1. A spring pre-tensioning device for a roll blind, the pre-tensioning device comprising:

a rotation shaft including a threaded part having a predetermined length and provided on an outer circumferential surface of a first side of the rotation shaft, a locking groove provided at an end of a second side of the rotation shaft, and a restraining protrusion provided on the outer circumferential surface of the rotation shaft and disposed at an end of the threaded part;

a restraining nut engaged with the threaded part of the rotation shaft, wherein the restraining protrusion provided at the end of the threaded part prevents the restraining nut from moving out of the threaded part toward the second side of the rotation shaft;

a restraining body fitted over the outer circumferential surface of the rotation shaft and including a shaft insertion hole formed along a central axis of the restraining body, a locking protrusion provided on an outer circumferential surface of a first side of the restraining body, and a nut insertion hole formed in a second side of the restraining body along the central axis thereof such that the restraining nut is inserted in the nut insertion hole; and a spring of which a first end is locked by the locking protrusion of the restraining body and a second end is coupled to the locking groove of the rotation shaft, wherein the restraining body is configured to apply a predetermined pretension value to the spring, and the restraining nut is locked by the restraining protrusion to retain the predetermined pretension of the spring.

2. The pre-tensioning device of claim 1, wherein the restraining body further includes a locking clip provided at an end of the second side of the restraining body to lock the restraining nut in the nut insertion hole such that the restraining body is prevented from being separated from the restraining nut.

3. The pre-tensioning device of claim 1, wherein the rotation shaft and the restraining nut are made of a metal material so as to endure elastic tension of the spring.

4. The pre-tensioning device of claim 1 further comprising:

a rotating member engaged with the locking groove of the rotation shaft and provided with a coupling groove; and a bracket coupled to the coupling groove of the rotating member by being inserted therein.

5. The pre-tensioning device of claim 4, wherein the bracket includes:

a body provided with a guide groove at each of opposite sides of a front surface thereof, and provided with a stop groove, the body being open at a lower portion thereof;

a coupling member provided on a front surface thereof with a coupling protrusion that protrudes outwardly and is engaged with the guide groove of the body, and provided on a back surface thereof with a groove; and an elastic stopper integrally provided in the groove of the coupling member and protruding outwardly, with a separation pin provided at a lower portion of the elastic stopper.

6. A spring pre-tensioning device for a roll blind, the pre-tensioning device comprising:

a rotation shaft including a screw provided on an outer circumferential surface of a first side of the rotation shaft, a restraining protrusion provided on the outer circumferential surface of the rotation shaft and disposed at an end of the screw, and a locking groove provided at an end of a second side of the rotation shaft;

a restraining body fitted over the outer circumferential surface of the rotation shaft and including a shaft insertion hole formed along a central axis of the restraining body, a locking protrusion provided on an outer circumferential surface of a first side of the restraining body, a pin insertion hole formed at a second side of the restraining body, and a locking pin inserted in the pin insertion hole such that an end of the locking pin is engaged with a root of the screw of the rotation shaft, wherein the restraining protrusion provided at the end of the screw prevents the locking pin from moving out of the screw toward the second side of the rotation shaft; and a spring of which a first end is locked by the locking protrusion of the restraining body and a second end is coupled to the locking groove of the rotation shaft, wherein the restraining body is configured to apply tension to the spring, and the locking pin is locked by the restraining protrusion to restrain the tension of the spring.

7. The pre-tensioning device of claim 6 further comprising:

a rotating member engaged with the locking groove of the rotation shaft and provided with a coupling groove; and a bracket coupled to the coupling groove of the rotating member by being inserted therein.

8. The pre-tensioning device of claim 6, wherein the rotation shaft is made of a metal material so as to endure elastic tension of the spring.

* * * * *